US007312772B2

(12) United States Patent
Kim

(10) Patent No.: US 7,312,772 B2
(45) Date of Patent: Dec. 25, 2007

(54) CONTROLLING THE BRIGHTNESS OF IMAGE DISPLAY DEVICE

(75) Inventor: Jung-woo Kim, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 603 days.

(21) Appl. No.: 10/855,556

(22) Filed: May 28, 2004

(65) Prior Publication Data

US 2005/0078127 A1 Apr. 14, 2005

(30) Foreign Application Priority Data

Oct. 9, 2003 (KR) ..... 10-2003-0070426

(51) Int. Cl.
*G09G 3/36* (2006.01)

(52) U.S. Cl. ..... 345/77; 345/89; 345/204; 345/214; 345/690; 349/33; 349/61

(58) Field of Classification Search ..... 345/63, 345/77, 88, 89, 100, 204, 210, 214, 690; 349/33, 61

See application file for complete search history.

(56) References Cited

U.S. PATENT DOCUMENTS 6,076,171 A * 6/2000 Kawata ..... 713/501
6,317,111 B1 * 11/2001 Nito et al. ..... 345/88
6,384,817 B1 5/2002 Janssen et al.
6,466,187 B1 10/2002 Moon
2002/0158892 A1 10/2002 Kim et al.
2003/0001945 A1 * 1/2003 Maeda ..... 347/252
2003/0011545 A1 1/2003 Sagano et al.
2003/0011625 A1 1/2003 Kellis
2003/0122759 A1 7/2003 Abe et al.
2003/0214242 A1 11/2003 Berg-johansen
2004/0008176 A1 1/2004 Nuimura
2004/0027361 A1 2/2004 Chow
2004/0041824 A1 3/2004 Willis
2004/0061708 A1 4/2004 Oh

* cited by examiner

*Primary Examiner*—Bipin Shalwala
*Assistant Examiner*—Vincent E. Kovalick
(74) *Attorney, Agent, or Firm*—Robert E. Bushnell, Esq.

(57) ABSTRACT

Controlling the brightness of an image display device includes generating a clock signal having a frequency that varies according to locations of row electrodes in a predetermined column line and generating a signal having a pulse width corresponding to a gray scale value of an input image signal in accordance with the clock signal corresponding to the location of the row electrode of a pixel at which an image signal is to be displayed.

12 Claims, 8 Drawing Sheets

CONTROLLING THE BRIGHTNESS OF IMAGE DISPLAY DEVICE

CLAIM OF PRIORITY

This application claims priority under 35 U.S.C. § 119 of Korean Patent Application No. 2003-70426, filed on Oct. 9, 2003, in the Korean Intellectual Property Office, the disclosure of which is incorporated by reference herein in its entirety.

BACKGROUND OF THE INVENTION

1. Field of the Invention

The present invention relates to controlling brightness in an image display device, and more particularly, to controlling brightness in a flat panel display, for example, such that each pixel of the display device has the same brightness for a given image signal.

2. Description of the Related Art

An image display device, such as a flat panel display, which generally includes groups of column electrodes and row electrodes arranged in a matrix, uses a driving circuit connected to each of the groups of electrodes to represent images. To improve the manufacturing efficiency and reduce the size of flat panel displays and their manufacturing costs, the driving circuit is typically connected to one side of the group of column electrodes or one side of the group of row electrodes. Accordingly, areas on the screen that are far from the driving circuit have poorer brightness characteristics than areas on the screen that are in close proximity to the driving circuit due to the resistance of the material of the electrodes of the flat panel display and the capacitance between the electrodes.

One method of representing a gray scale in a flat panel display controls the brightness with a driving circuit to drive a group of column electrodes in response to the amplitude of a voltage applied to the column electrodes by using amplitude modulation. The farther a column electrode is from the driving circuit, the smaller the voltage provided by the driving circuit. In order to prevent this phenomenon, a voltage V1 is applied to a first row electrode for a predetermined image signal and a voltage VN is applied to a last row electrode for the predetermined image signal, and the farther the row electrode is from the driving circuit, the larger the voltage provided to the row electrode by the driving circuit. Accordingly, the same voltage can be applied to each pixel placed along the group of column electrodes by compensating for voltage variations that depend on the distance between each row electrode and the driving circuit. Therefore, each pixel in a column can display uniform brightness.

However, in such a method of controlling brightness using amplitude modulation, the voltage applied to each column electrode must be varied in order to prevent brightness deteriorations in the columnar direction. Therefore, a power supply circuit and a control circuit are additionally required, which results in an increase in power consumption and cost.

SUMMARY OF THE INVENTION

The present invention provides a method and apparatus to control the brightness in an image display device, such as a flat panel display, using a pulse width modulation (PWM) technique for gray scale representation such that each pixel on the display device has the same brightness for a given same image signal.

According to an aspect of the present invention, a method of controlling brightness in an image display device is provided, the method comprising: generating a clock signal having a frequency that varies according to locations of row electrodes in a predetermined column line; and generating a signal having a pulse width corresponding to a gray scale value of an input image signal in accordance with the clock signal corresponding to a location of a row electrode of a pixel at which an image signal is to be displayed.

According to another aspect of the present invention, an apparatus to control the brightness in an image display device is provided, the apparatus comprising: a variable clock signal generator adapted to generate a clock signal having a frequency that varies according to locations of row electrodes in a predetermined column line; and a pulse width modulation signal generator adapted to generate a signal having a pulse width that corresponds to a gray scale value of an input image signal in accordance with the clock signal corresponding to the location of the row electrode of a pixel at which an image signal is to be displayed.

According to yet another aspect of the present invention, a program storage device is provided, the program storage device, readable by a machine, tangibly embodies a program of instructions executable by the machine to perform a method of controlling brightness in an image display device, the method comprising: generating a clock signal having a frequency that varies according to locations of row electrodes in a predetermined column line; and generating a signal having a pulse width corresponding to a gray scale value of an input image signal in accordance with the clock signal corresponding to a location of a row electrode of a pixel at which an image signal is to be displayed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, the present invention will be described more fully with reference to the accompanying drawings in which exemplary embodiments of the invention are shown.

FIGS. 1A-1D are timing diagram of a pulse width modulation (PWM) method of representing the gray scale of a flat panel display. FIGS. 1A-1D respectively represent a clock signal having a predetermined frequency, a synchronization signal, a count signal, and a PWM signal.

Figures 1A, 1B, 1C, 1D:
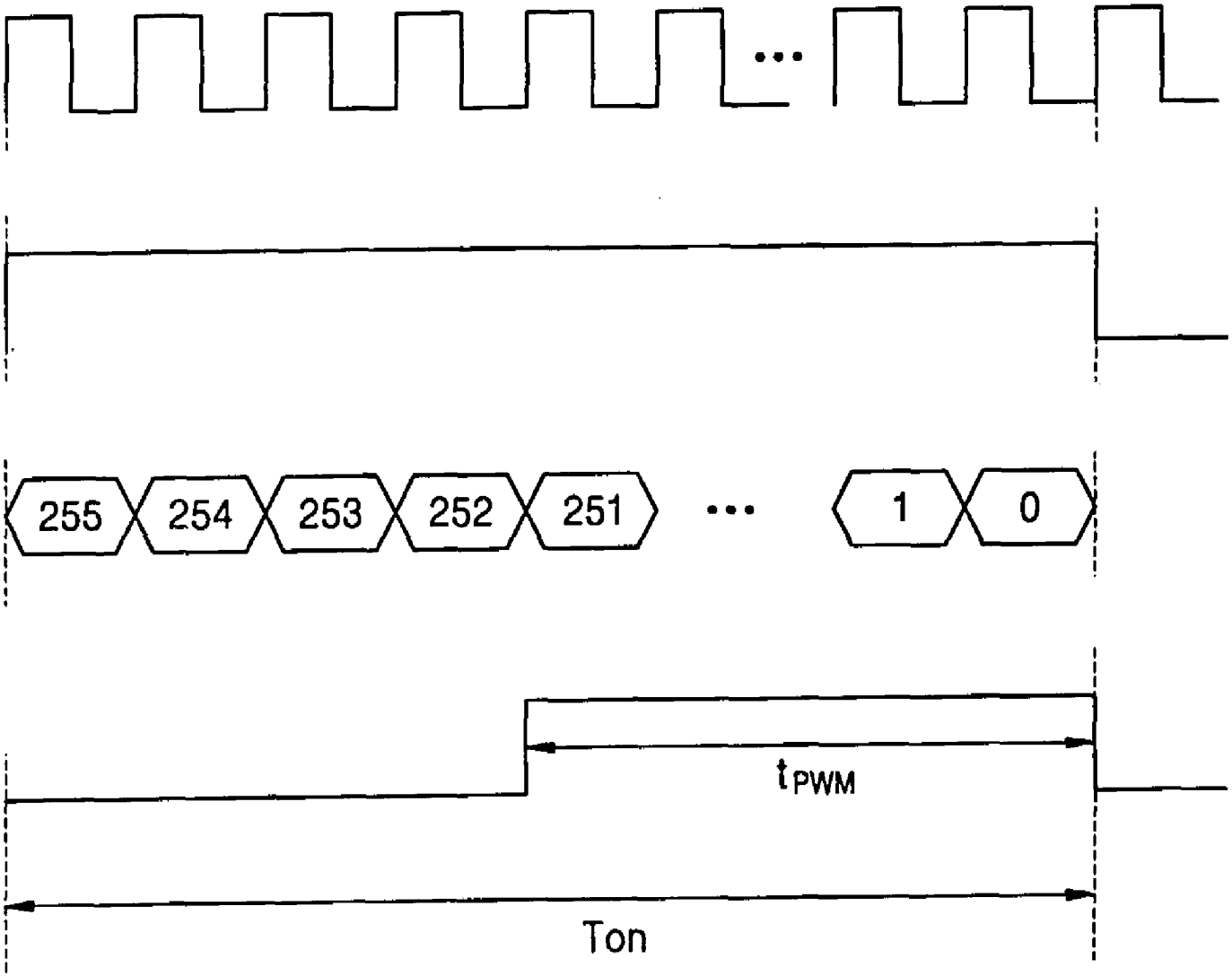
FIGS. 1A-1D are timing diagrams of a pulse width modulation technique of representing a gray scale of a flat panel display.

Assume that image data has an 8-bit gray scale value. Referring to FIGS. 1A-1D, while the synchronization signal is in a logic high state, 256 clock pulses are counted. The total period of 256 clock pulses of the clock signal while the synchronization signal is in the logic high state is defined as an on-time period $T_{on}$. Assuming that image data to be displayed has a gray scale of 251, a PWM signal having pulse width $t_{WZM}$ is generated, as shown in FIG. 1D. The pulse width $t_{WZM}$ can be expressed using Equation (1) below.

$$t_{PWM} = \frac{T_{on}}{G_{tot}} G_{in} \tag{1}$$

In Equation (1), $G_{tot}$ and $G_{in}$ are respectively the number of gray scale values that can be represented and the gray scale of the image data to be displayed.

In other words, according to the PWM method, when a pulse width is proportional to a brightness and a gray scale is represented by 8 bits, 256 pulse widths can be generated from the on-time period $T_{on}$. Thereafter, a PWM signal is generated having a pulse width adjusted according to the gray scale of the image data to be displayed. The PWM signal is applied to a column or row driving circuit.

Figure 2:
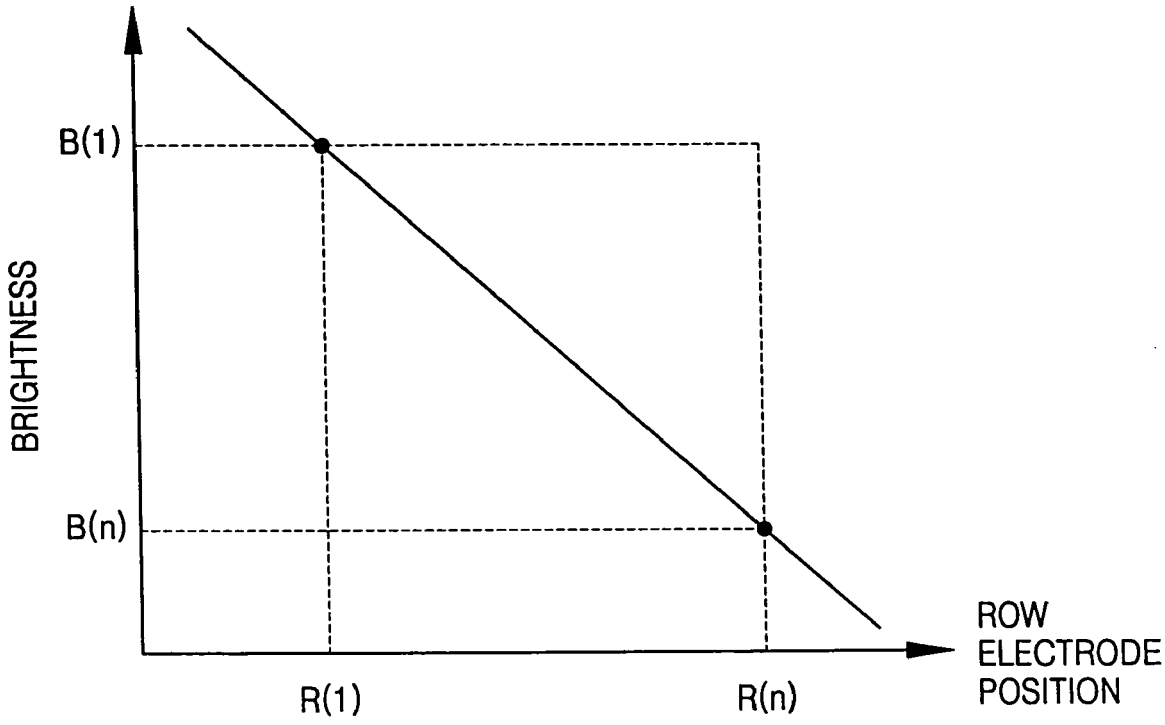
FIG. 2 is a graph of the brightness characteristics of a flat panel display according to the position of a group of row electrodes.

FIG. 2 is a graph of brightness characteristics of a flat panel display according to the position of a group of row electrodes. Referring to FIG. 2, R(1) represents a first row electrode located closest to a column driving circuit, R(n) represents an n-th row electrode located farthest from the column driving circuit, B(1) is brightness measured at the row electrode R(1) for a predetermined image signal, and B(n) is brightness measured at the row electrode R(n) for the predetermined image signal. In the flat panel display, the farther the electrode is from the driving circuit, the lower the brightness of the flat panel display for a predetermined image signal.

Figure 3A:
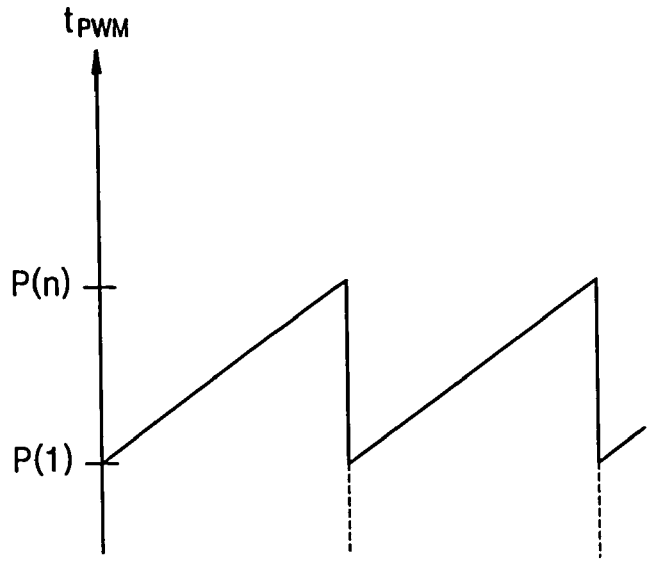
FIGS. 3A-3B are graphs of a method of controlling the brightness of a flat panel display according to an embodiment of the present invention.
Figure 3B:
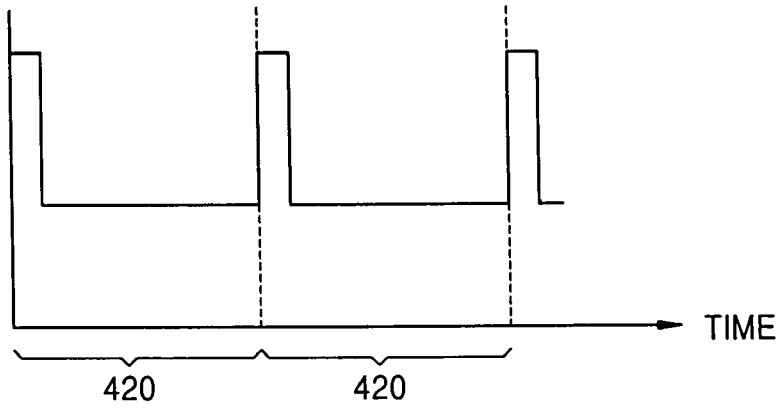

FIGS. 3A-3B are timing diagrams of a method of controlling brightness of a flat panel display according to an embodiment of the present invention. FIG. 3A represents a pulse width $t_{PWM}$ that varies according to the position of a row electrode, and FIG. 3B represents a vertical synchronization signal. Referring to FIGS. 3A-3B, the pulse width of a PWM signal for an image signal gradually increases as the position of a row electrode becomes farther from a driving circuit. In other words, if a first row electrode R(l), located closest to a driving circuit, has pulse width P(1), then the n-th row electrode R(n), located farthest from the driving circuit, has pulse width P(n). Row electrodes between the first and n-th row electrodes R(1) and R(n) have pulse widths that are determined according to a predetermined gradient. In order to create PWM signals whose pulse widths, for an image signal that has a predetermined gray scale, vary according to the position of a row electrode, the frequency of a clock signal used for the creation of the PWM signals is varied.

Figure 4:
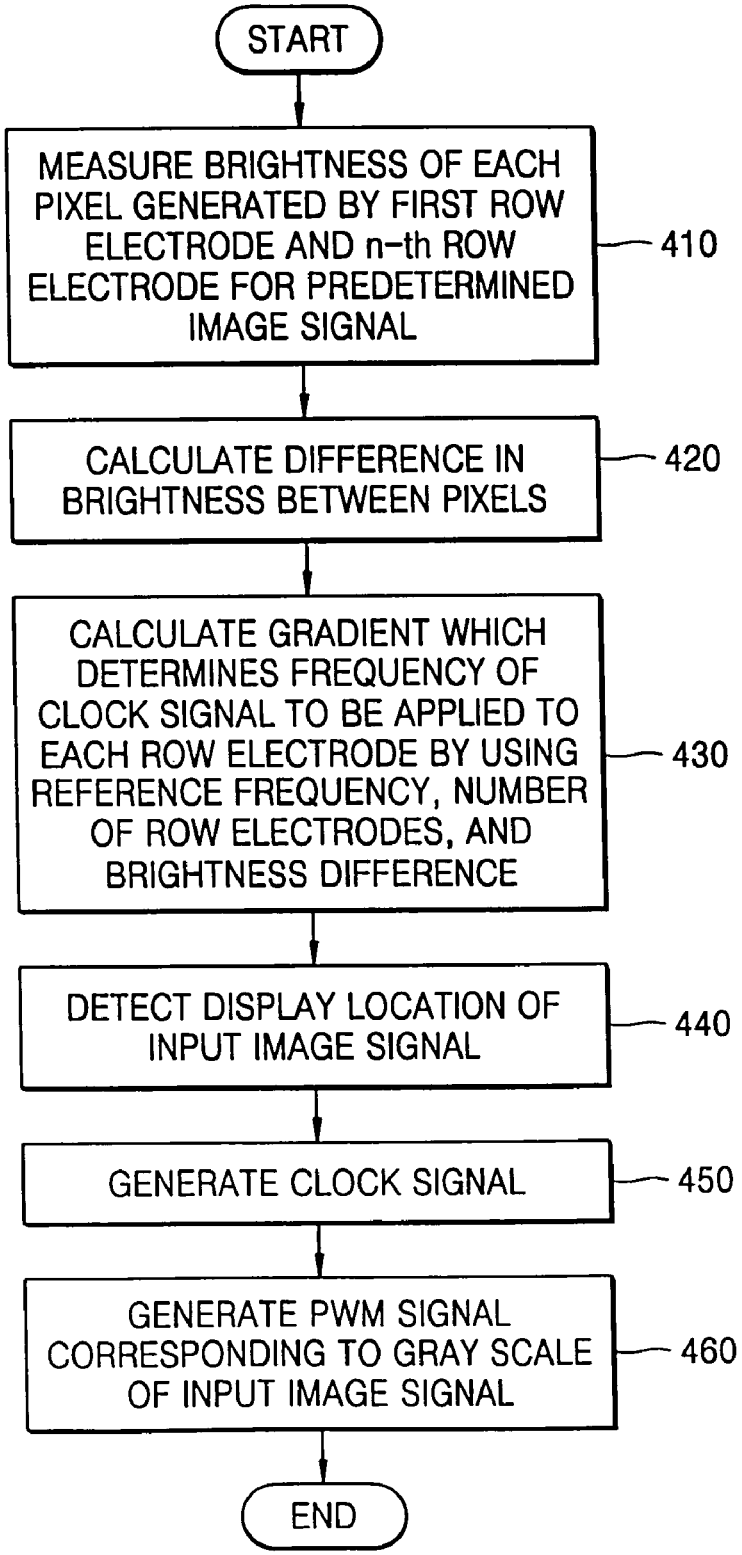
FIG. 4 is a flowchart of a method of controlling the brightness of a flat panel display according to an embodiment of the present invention.

FIG. 4 is a flowchart of a method of controlling the brightness of a flat panel display according to an embodiment of the present invention, in which groups of column electrodes and row electrodes are driven according to a PWM technique.

Referring to FIG. 4, in step 410, a first brightness B(1) and an n-th brightness B(n) are measured at pixels respectively located at a first row electrode R(1) and an n-th row electrode R(n) by applying image signals having the same gray scale value to the first and n-th row electrodes R(1) and R(n). The first row electrode R(l) is located at the top of a predetermined column line, and the n-th row electrode R(n) is located at the bottom of the predetermined column line. Assume that the first row electrode R(1) is located closest to a driving circuit.

In step 420, a difference between the first and n-th brightnesses B(1) and B(n) is detected.

In step 430, the frequency of a clock signal to be used for creating a PWM signal is determined using a reference frequency, the number of row electrodes, and the difference between the first and n-th brightnesses B(1) and B(n) detected in step 420. The PWM signal will be applied to the first row electrode R(1) later. In other words, a gradient is calculated using the number of row electrodes and the difference between the first and n-th brightnesses B(1) and B(n), and the frequency of the clock signal to be applied to each row electrode is obtained using the calculated gradient.

In step 440, the location of an input image signal to be displayed on a display device is detected using a vertical synchronization signal and a horizontal synchronization signal.

In step 450, a clock signal having a frequency corresponding to the position of a row electrode is generated. The position of the row electrode is obtained using the location of the input image signal detected in step 440.

In step 460, a PWM signal corresponding to the gray scale of the input image signal is generated using the clock signal generated in step 450, and then the PWM signal is transmitted to the driving circuit.

Figure 5:
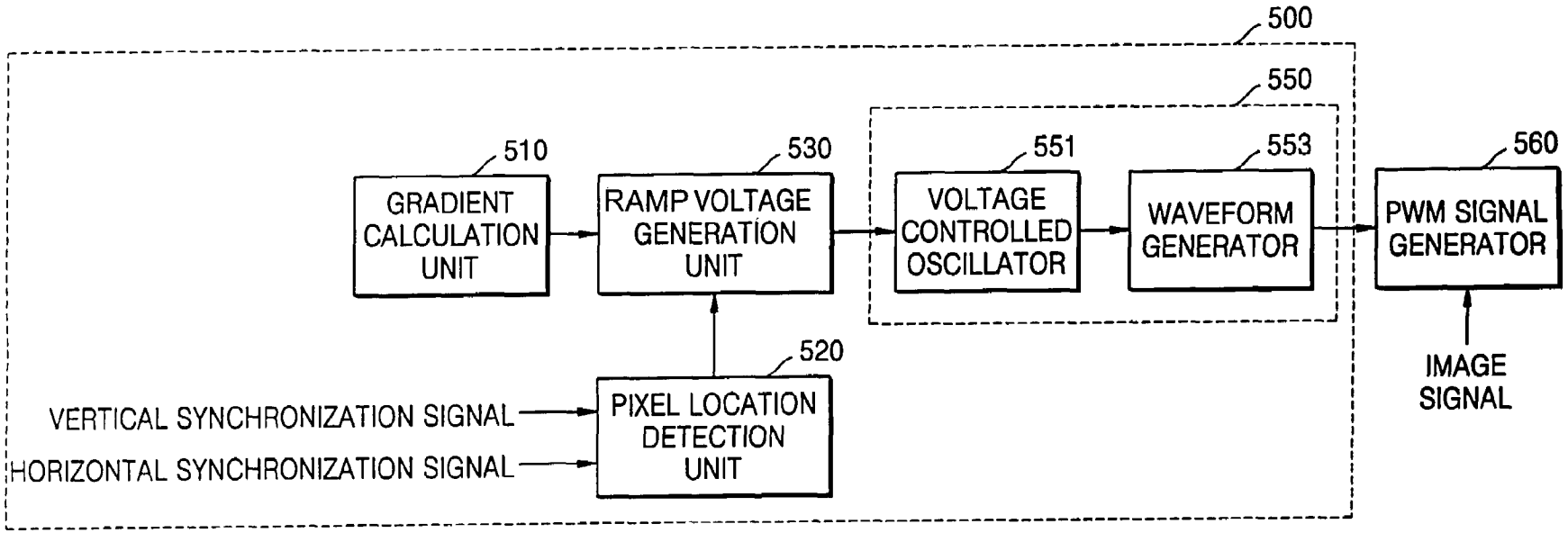
FIG. 5 is a block diagram of an apparatus to control the brightness of a flat panel display according to an embodiment of the present invention.

FIG. 5 is a block diagram of an apparatus to control the brightness of a flat panel display according to an embodiment of the present invention. Referring to FIG. 5, the apparatus includes a variable clock signal generation unit 500 and a clock signal generation unit 550. The variable clock signal generation unit 500 comprises a gradient calculation unit 510, a pixel location detection unit 520, and a ramp voltage generation unit 530.

Figure 6A:
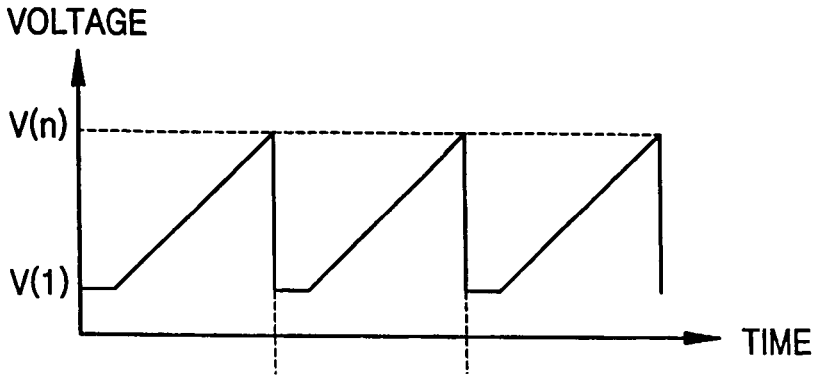
FIGS. 6A-6B are timing diagrams of the operation of each element of the apparatus of FIG. 5.
Figure 6B:
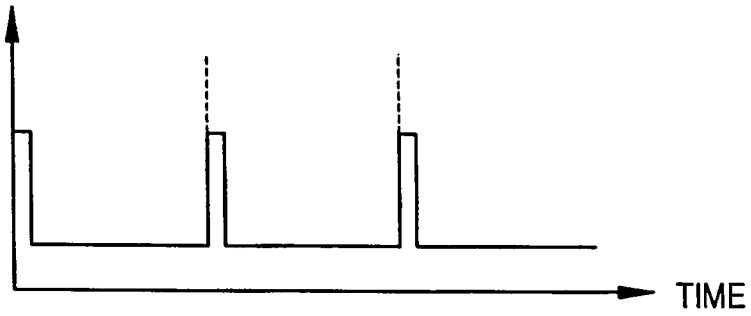
Figure 6C:
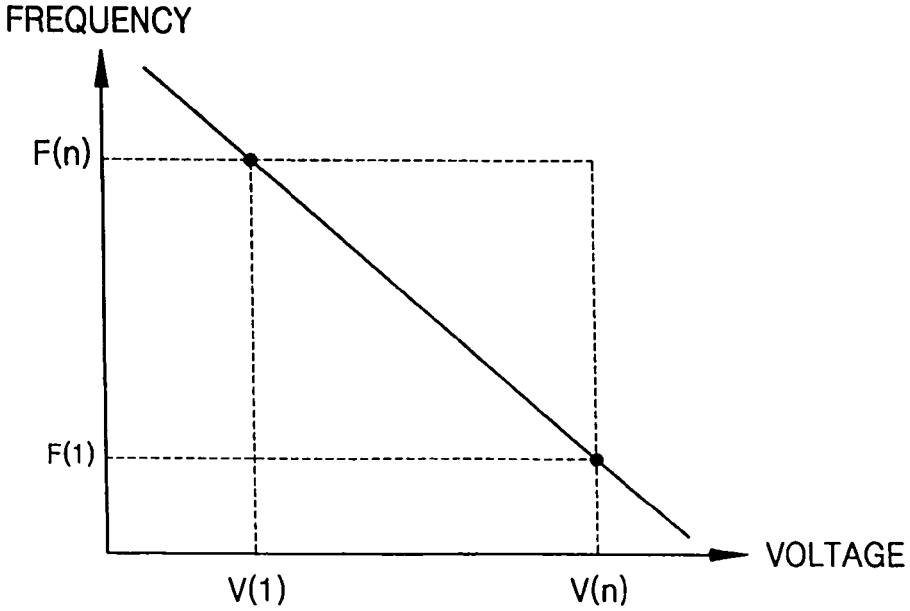
FIG. 6C is a graph of the frequency-voltage characteristics of a waveform generator of the apparatus of FIG. 5.

FIGS. 6A-6B are timing diagrams of the operation of each element of the apparatus of FIG. 5, and FIG. 6C is a graph illustrating the frequency-voltage characteristics of a voltage-controlled oscillator 551 of the apparatus of FIG. 5. The operation of the apparatus of FIG. 5 will be described in the following paragraphs with reference to FIGS. 5 and 6A-6C.

Referring to FIG. 5, the gradient calculation unit 510 measures a first brightness B(1) and an n-th brightness B(n) at pixels respectively located at a first row electrode R(1) and an n-th row electrode R(n) by applying image signals that have the same gray scale value to the first and n-th row electrodes R(1) and R(n). The first row electrode R(1) is located at the top of a predetermined column line, and the n-th row electrode R(n) is located at the bottom of the predetermined column line. The gradient calculation unit 510 detects a difference between the first and n-th brightnesses B(1) and B(n) and calculates a gradient using a reference frequency of a clock signal to be used for creating a PWM signal, the number of row electrodes, and the difference between the first and n-th brightnesses B(1) and B(n). The gradient is used to determine the frequency of clock signals necessary for each of row electrodes.

The pixel location detection unit 520 detects the location of an input image signal to be displayed on a display device using a vertical synchronization signal and a horizontal synchronization signal and controls the ramp voltage generation unit 530 such that the ramp voltage generation unit 530 generates a voltage required to generate a clock signal that corresponds to the location of a row electrode.

The ramp voltage generation unit 530 generates a ramp voltage, which is proportional to a pulse width that corresponds to the row electrode detected by the pixel location detection unit 520, using the gradient calculated by the gradient calculation unit 510. An example of the ramp voltage generated by the ramp voltage generation unit 530 is illustrated in FIG. 6A.

The clock signal generation unit 550 can include a voltage control oscillator 551 and a waveform generator 553. The voltage controlled oscillator 551 generates an oscillation signal whose frequency corresponds to the voltage output from the ramp voltage generation unit 530 and outputs the oscillation signal to the waveform generator 553. The waveform generator 553 generates a clock signal necessary for PWM using the oscillation signal output by the voltage controlled oscillator 553. In other words, the frequency of the oscillation signal generated by the voltage controlled oscillator 552 varies according to the position of a row electrode, as shown in FIG. 6B. Thus, a clock signal is generated to have a frequency that decreases and a cycle that is lengthened as a corresponding row electrode is farther from a driving circuit. Therefore, the pulse width of a PWM signal increases for image signals having the same gray scale, and a constant level of brightness can be obtained by compensating for voltage variations depending on locations of row electrodes.

The waveform of a 32" carbo-nano tube field emission device (CNT FED) having a resolution of 704×480 is illustrated. If an image signal currently being input is to be displayed over an area that ranges from a row electrode R(480), which is a bottom electrode, to a row electrode R(1), which is a top electrode, clock signals that have different frequencies are generated. More specifically, the period of the clock signal generated for the row electrode R(480) is much longer than the period of the clock signal generated for the row electrode R(1).

Figure 7A:
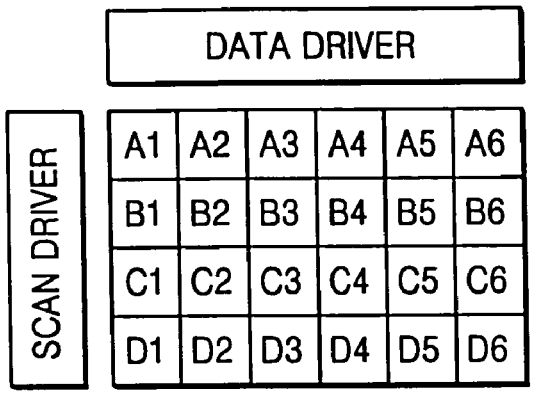
FIGS. 7A-7C are diagrams comparing the performance of a conventional method of controlling the brightness using PWM with the performance of a method of controlling the brightness according to an embodiment of the present invention.
Figure 7B:
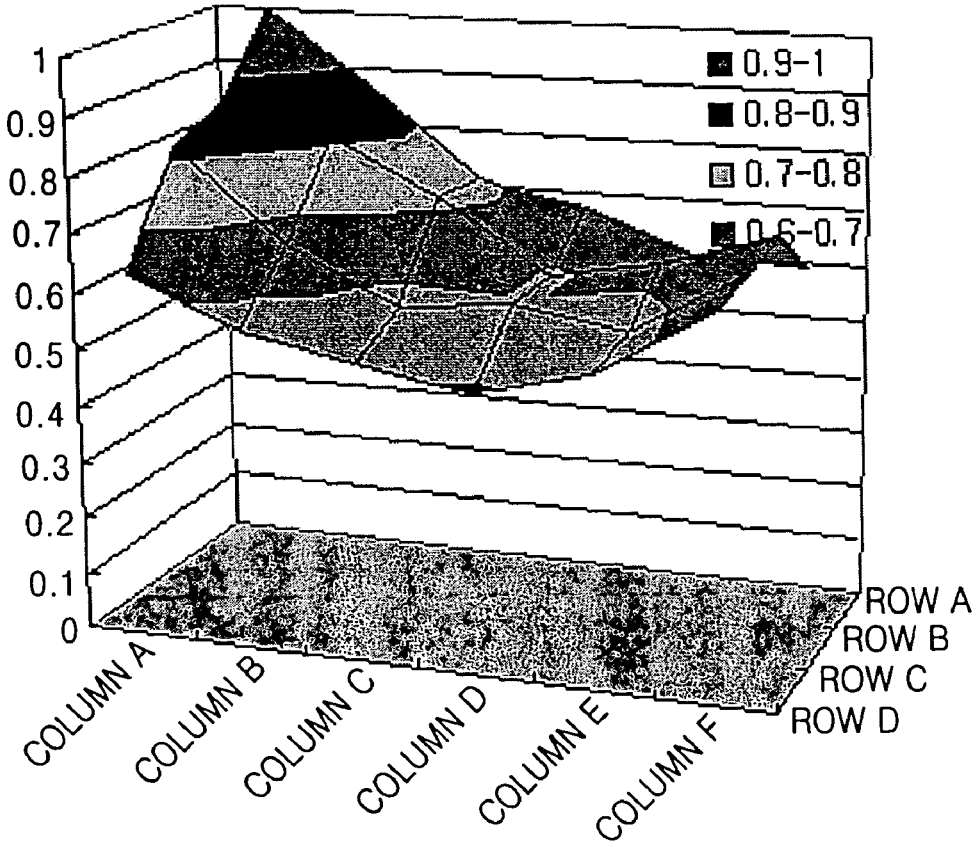
Figure 7C:
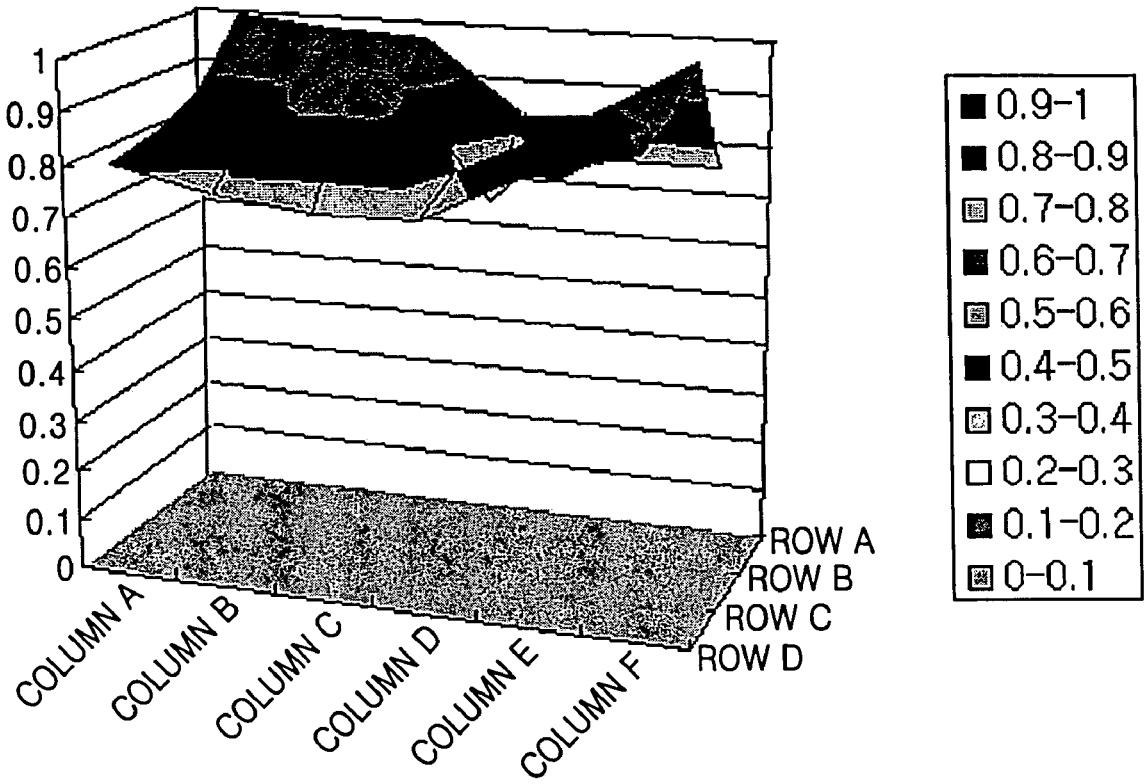

FIGS. 7A through 7C are diagrams in which the performance of a method of controlling brightness according to an embodiment of the present invention is compared with the performance of a conventional PWM method. As shown in FIG. 7A, when each group of electrodes is formed using a 32" CNT FED having a resolution of 704×480, the brightness according to the location of each group of electrodes using a conventional PWM method is illustrated in FIG. 7B. As shown in FIG. 7B, the conventional PWM method provides a brightness uniformity of about 60%. The distribution of brightness according to the location of each group of electrodes when using a method of controlling brightness according to an embodiment of the present invention is illustrated in FIG. 7C. As shown in FIG. 7C, the present invention provides a brightness uniformity of about 80%.

The exemplary embodiments of the present invention can be realized as computer-readable code written on a computer-readable recording medium. That is, embodiments of the present invention can be realized as a program the storage device, readable by a machine, tangibly embodying a program of instructions executable by the machine to perform the method of controlling brightness in an image display device as noted above. The computer-readable recording medium includes all types of recording devices on which data can be recorded in a computer-readable manner. For example, the computer-readable recording medium includes a ROM, a RAM, a CD-ROM, a magnetic tape, a floppy disk, an optical data storage device, and a carrier wave, such as data transmission through the Internet. The computer-readable recording medium can be distributed over a plurality of computer systems that are connected to one another by a network, such that data can be stored in the computer-readable recording medium in a decentralized manner. In addition, functional programs, codes, and code segments that realize the present invention can be easily inferred by those skilled in the art.

As described above, according to exemplary embodiments of the present invention, the pulse width of PWM signals for image signals that have the same gray scale values for different locations is increased in proportion to the distance between each row electrode and a driving circuit. Therefore, it is possible to provide excellent brightness uniformity for a group of column electrodes in a flat panel display by adding only a simple circuit rather than a power supply circuit or a control circuit which would increase energy consumption and complicate the design of the flat panel display.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A method of controlling brightness in an image display device, the method comprising:

(a) generating a clock signal having a frequency that varies according to locations of row electrodes in a predetermined column line;

(b) generating a signal having a pulse width corresponding to a gray scale value of an input image signal in accordance with the clock signal corresponding to a location of a row electrode of a pixel at which an image signal is to be displayed; and providing the signal having a pulse width corresponding to a gray scale value to the image display device to control its brightness.

2. The method of claim 1, wherein generating a clock signal comprises:

calculating a gradient; and generating the clock signal in accordance with the gradient.

3. The method of claim 2, wherein the gradient is calculated in accordance with a difference in brightness between a pixel in the predetermined column line that corresponds to a row electrode closest to a column driving circuit and a pixel in the predetermined column line that corresponds to a row electrode farthest from the column driving circuit, a reference frequency of the clock signal, and a number of row electrodes of the image display device.

4. The method of claim 2, wherein generating the clock signal in accordance with the gradient comprises:

generating a ramp voltage that varies according to the location of each of the row electrodes using the gradient;

extracting a voltage level from the ramp voltage corresponding to a location in a row electrode where the input image signal is to be displayed and generating an oscillation signal having a frequency corresponding to the extracted voltage level; and generating a clock signal for each pixel where the input image signal is to be displayed in accordance with the oscillation signal.

5. A program storage device, readable by a machine, tangibly embodying a program of instructions executable by the machine to perform a method of controlling brightness in an image display device, the method comprising:

(a) generating a clock signal having a frequency that varies according to locations of row electrodes in a predetermined column line;

(b) generating a signal having a pulse width corresponding to a gray scale value of an input image signal in accordance with the clock signal corresponding to a location of a row electrode of a pixel at which an image signal is to be displayed; and providing the signal having a pulse width corresponding to a gray scale valve to the image display device to control its brightness.

6. The program storage device of claim 5, wherein generating a clock signal comprises:

calculating a gradient; and generating the clock signal in accordance with the gradient.

7. The program storage device of claim 6, wherein the gradient is allocated in accordance with a difference in brightness between a pixel in the predetermined column line that corresponds to a row electrode closest to a column driving circuit and a pixel in the predetermined column line that corresponds to a row electrode farthest from the column driving circuit, a reference frequency of the clock signal, and a number of row electrodes of the image display device.

8. The program storage device of claim 6, wherein generating the clock signal in accordance with the gradient comprises:

generating a ramp voltage that varies according to the location of each of the row electrodes using the gradient;

extracting a voltage level from the ramp voltage corresponding to a location in a row electrode where the input image signal is to be displayed and generating an oscillation signal having a frequency corresponding to the extracted voltage level; and generating a clock signal for each pixel where the input image signal is to be displayed in accordance with the oscillation signal.

9. An apparatus adapted to control brightness in an image display device, the apparatus comprising:

a variable clock signal generator adapted to generate a clock signal having a frequency that varies according to locations of row electrodes in a predetermined column line; and a pulse width modulation signal generator adapted to generate a signal having a pulse width corresponding to a gray scale value of an input image signal in accordance with the clock signal corresponding to the location of the row electrode of a pixel at which an image signal is to be displayed.

10. The apparatus of claim 9, wherein the variable clock signal generator comprises:

a gradient calculator adapted to calculate a gradient;

a ramp voltage generator adapted to generate a ramp voltage in accordance with the gradient; and a clock signal generator adapted to generate the clock signal in accordance with the generated ramp voltage.

11. The apparatus of claim 10, wherein the gradient calculator is adapted to calculate the gradient in accordance with a difference in brightness between a pixel in a predetermined column line corresponding to a row electrode closest to a column driving circuit and a pixel in the predetermined column line corresponding to a row electrode farthest from the column driving circuit, a reference frequency of the clock signal, and the number of row electrodes of the image display device, the brightness difference being measured by applying an image signal having a predetermined gray scale value to the predetermined column line.

12. The apparatus of claim 10, wherein the clock signal generator comprises:

a voltage controlled oscillator adapted to detect a voltage level of the ramp voltage generated by the ramp voltage generator corresponding to the location of a pixel where the input image signal is to be displayed and to generate an oscillation signal having a frequency corresponding to the detected voltage level; and a waveform generator adapted to generate the clock signal in accordance with the oscillation signal generated by the voltage controlled oscillator.

* * * * *